US006572102B2

(12) United States Patent
Vedoy

(10) Patent No.: US 6,572,102 B2
(45) Date of Patent: Jun. 3, 2003

(54) CATCH TRAY FOR SHEET FEEDER WITH ADJUSTABLE DEPTH FEATURE

(75) Inventor: Arild Vedoy, White Bear Lake, MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 34 days.

(21) Appl. No.: 10/032,519

(22) Filed: Oct. 18, 2001

(65) Prior Publication Data

US 2003/0075858 A1 Apr. 24, 2003

(51) Int. Cl.[7] ..... B15H 31/02; B15H 31/20; B15H 31/22

(52) U.S. Cl. ..... 271/224; 271/223; 399/405

(58) Field of Search ..... 271/223, 224, 271/171; 399/405

(56) References Cited

U.S. PATENT DOCUMENTS

| | | | | | |
|---|---|---|---|---|---|
| 1,700,990 | A | * | 2/1929 | Sullivan | 271/223 |
| 3,117,778 | A | * | 1/1964 | Stoever | 271/223 |
| 3,912,258 | A | * | 10/1975 | Martin | 271/184 |
| 4,162,641 | A | * | 7/1979 | Stubbings | 83/76.8 |
| 4,436,469 | A | * | 3/1984 | Kelly | 412/16 |
| 4,529,190 | A | * | 7/1985 | Goodwin et al. | 271/213 |
| 4,819,930 | A | * | 4/1989 | Jackson et al. | 271/209 |
| 4,930,762 | A | * | 6/1990 | Kitchens | 271/11 |
| 6,050,563 | A | | 4/2000 | Vedoy et al. | 271/10.07 |
| 6,206,363 | B1 | | 3/2001 | Vedoy et al. | 271/176 |

FOREIGN PATENT DOCUMENTS

| | | | | |
|---|---|---|---|---|
| CH | 270552 | * | 12/1950 | 271/223 |

* cited by examiner

*Primary Examiner*—Donald P. Walsh
*Assistant Examiner*—Daniel K Schlak
(74) *Attorney, Agent, or Firm*—Nikolai & Mersereau, P.A.

(57) ABSTRACT

An adjustable sheet tray for receiving sheets of material from a sheet feeding machine which counts out a number of sheets to be added to a stack. The sheet tray receives the sheets and allows the stacks to be easily removed. The sheet tray is easily adjustable for the length and width of the sheets delivered to it and for the depth of the stack of sheets. The sheet tray has a sensor, which tells the sheet feeder to start sending more sheets to it when it senses that the stack of sheets in the sheet tray has been removed. A spring loaded hanging finger provides a stop on an otherwise open end of the sheet tray and is pushed up and out of the way when a stack of sheets is removed from the sheet tray and returns the fingers to their original position after the stack of sheets is removed.

6 Claims, 2 Drawing Sheets

CATCH TRAY FOR SHEET FEEDER WITH ADJUSTABLE DEPTH FEATURE

BACKGROUND OF THE INVENTION

1. Field of the Invention

This invention relates generally to an adjustable depth sheet feeding tray wherein a predetermined number of sheet articles may be fed, one at a time, to a catch tray assembly adapted to be attached to the frame of a sheet feeding machine in which a predetermined number of sheets can be accumulated and readily removed as a unit and where the removal of the sheet articles activates the sheet feeding machine for another cycle of sheet feeding to begin.

2. Description of the Related Art

In the applicants U.S. Pat. No. 6,050,563 and entitled "Sheet Feeder" issued Apr. 18, 2000, there is described an improved friction sheet feeder for feeding sheet-like articles, such as paper sheets, paper cards, plastic sheets or other flat products from a stack of such sheets contained in a hopper, one a time. The contents of that patent are hereby incorporated by reference. The machine therein described is readily suited to dealing out individual sheet articles to a collating conveyor where other sheet articles distributed from a different sheet feeder are combined to form a booklet or the like.

In certain applications, it is desirable to be able to rapidly accumulate a predetermined count of identical sheet articles for later boxing or packaging. Consider the case of greeting cards. A greeting card publisher may often wish to box or wrap 20 greeting cards and 20 envelopes as a unit. Sheet feeding equipment of the type described in applicant's above-referenced patent can readily be programmed to deal out 20 cards while a second such machine deals out 20 envelopes. When this is to be done on a repetitive basis and with a human operator taking the groups of 20 cards and 20 envelopes and placing them together for further processing, e.g., wrapping or boxing, it would be advantageous to have the removal of a set from a receptacle initiate another cycle of the sheet feeding machine so that as a first set is being inserted by an operator into a box, the sheet feeder can already be dealing out another set of sheet articles.

In applicant's U.S. Pat. No. 6,206,363 entitled "Catch Tray Attachment For Sheet Feeding Machine" issued Mar. 27, 2001 an accessory attachment for a sheet feeding machine electronically tied to the sheet feeder's motor controller, and having a signal sent to the sheet feeder to activate it for a predetermined number of sheet delivery cycles upon the removal of sheet articles from a catch tray was taught. The contents of that patent are hereby incorporated by reference.

The present invention improves on the U.S. Pat. No. 6,206,363 patent by providing a depth adjustment for the catch tray and having a substantially open bottom to the tray with a support plate for preventing the sheets in the catch tray from sagging in the middle of the sheets length. However, for narrow sheets or stiff products the support plate is not necessary and can be easily removed.

SUMMARY OF THE INVENTION

The present invention comprises a catch tray attachment for a sheet feeding machine of the type comprising a frame, an endless feed belt and a feed belt drive motor structure supported by the frame for driving an upper flight of the endless belt in a forward direction. Positioned above the upper flight of the endless belt is a hopper that supports a stack of sheet articles such that the lowermost sheet article in the stack contacts the upper flight of the endless belt. A stripper wheel cooperates with the upper flight to block all but the lowermost sheet article from passing between the stripper wheel and upper flight along a discharge path. The sheet feeding machine with which the catch tray is used further includes a microcomputer-based control circuit for controlling the drive motor structure.

The catch tray itself comprises a tray member having a generally planar base with first and second sides projecting perpendicularly to the base where each of said sides includes a longitudinal extension adapted for connection by bolts or the like to the frame of the sheet feeding machine so as to locate the tray member downstream of the discharge point of the sheet feeding machine. A stop assembly is suspended between the first and second sides and includes a stop member that is disposed in the discharge path of the sheet articles exiting the sheet feeding machine to cause sheet articles to drop onto the base ahead of the stop members. A sensor, such as a photo eye, is mounted on the base for detecting the removal of sheet articles from a resting position on the base and sending a control signal to the control circuit of the sheet feeding machine for restarting the motor a predetermined time after sheet articles fed from the sheet feeder are removed from the catch tray.

OBJECTS OF THE INVENTION

It is an object of the invention to provide a sheet tray for a sheet feeder which is easily adjustable for the length width and depth of the sheets fed into the sheet tray.

It is an object of the invention to provide side walls in the sheet tray which are adjustable in two dimensions.

Other objects, advantages and novel features of the present invention will become apparent from the following detailed description of the invention when considered in conjunction with the accompanying drawing.

DESCRIPTION OF THE PREFERRED EMBODIMENTS

Figure 1:
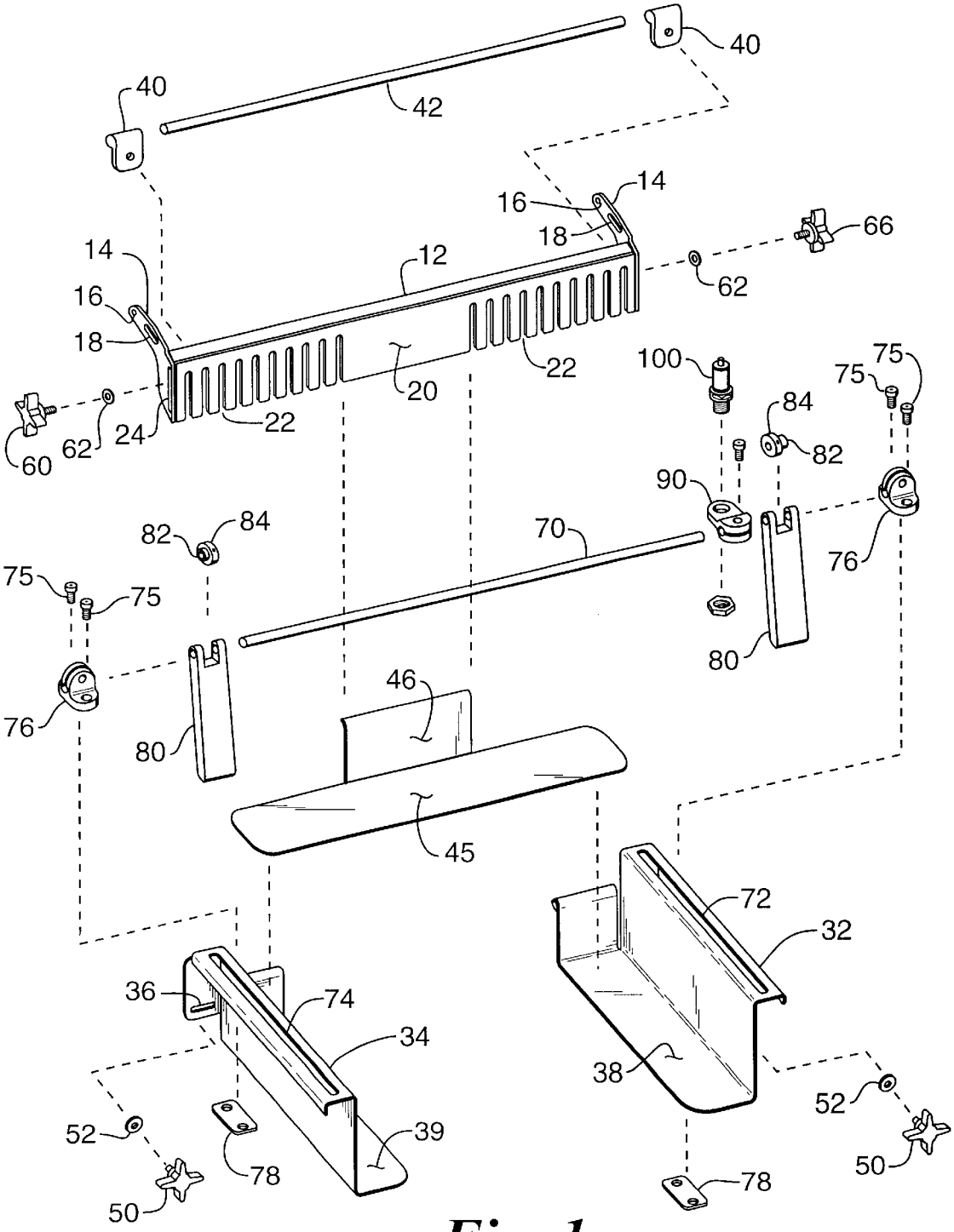
FIG. 1 is an exploded view of the parts used to assemble the sheet tray.
Figure 2:
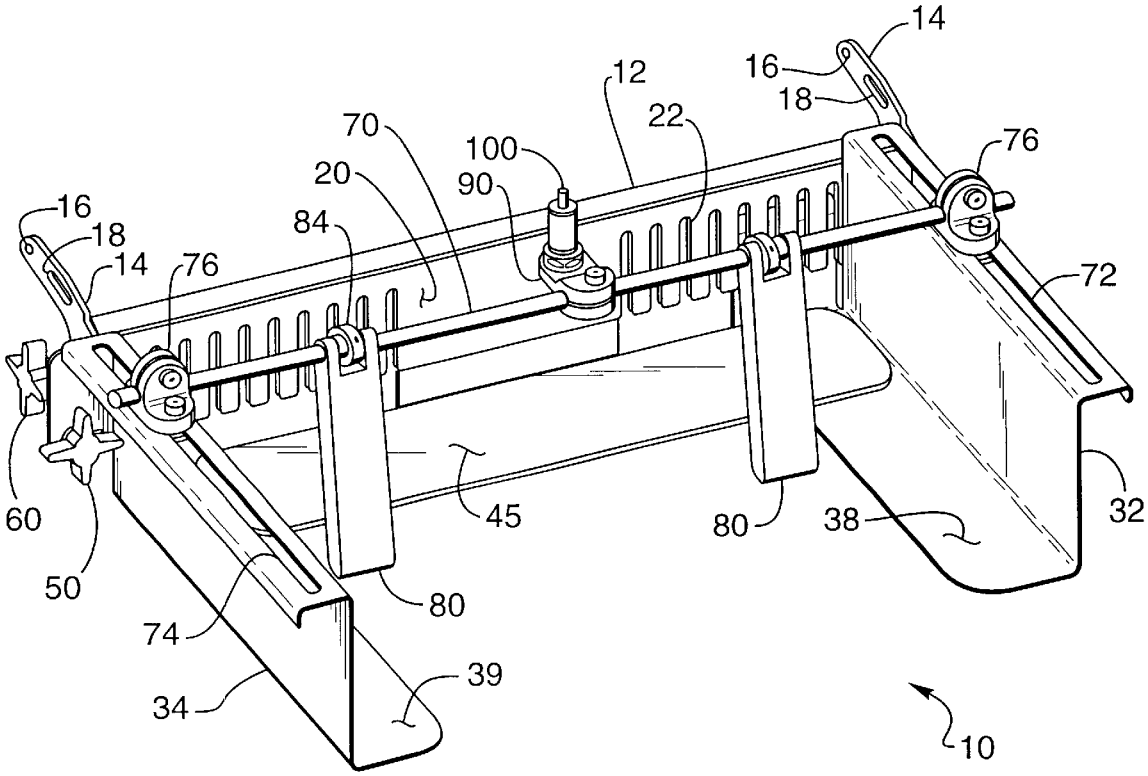
FIG. 2 is a perspective view of an assembled sheet tray.

FIG. 2 shows an assembled sheet tray 10. The individual parts making up the sheet tray 10 can best be seen in FIG. 1. The sheet tray 10 has a discharge plate 12 having arms 14 with apertures 16 and 18 for attaching the sheet tray 10 to a receiving shoot of a sheet feeding machine, a conveyor belt or other article delivery device. For an example of such attachment see U.S. Pat. No. 6,206,363 which is incorporated herein by reference. The discharge plate 12 also has a front face 20 with a plurality of slits 22 cut therein. The discharge plate 12 forms the back wall of the sheet tray 10 and adjustably supports the remaining portions of the sheet tray 10. The slits 22 allow air to escape from under the sheets as they are added to the stack in the sheet tray 10. The slits 22 are also used attach the tray side walls 32 and 34.

Tray side walls 32 and 34 are adjustably attached to the discharge plate 12 by placing knobs 50 having a threaded portion through the apertures 36 in the tray side walls 32 and 34. The threaded portion of the knobs 50 screw into brackets 40 which slide on guide rod 42 and are placed behind slits 22 in discharge plate 12. In this manner the brackets 40 can be placed behind any of the slots 22 to attach tray walls 32 and 34 in any desired position. The slots 36 in side walls 32 and 34 are long enough to provide for adjustments between the slits 22 on the discharge plate 12. Washers may be used on the treaded portion of knobs 50 to engage the front face 20 of the discharge plate 12. As can be readily understood the side walls can be easily adjusted to accommodate the width of any product being deposited into the sheet tray 10.

The depth of the sheet tray 10 is adjusted by moving guide rod 42 up or down relative to side slot 24 on discharge plate 12. Threaded knobs 60 have a threaded portion which threads into the guide rod 42 for locking the guide rod into position. Washers 62 can be used with the threaded knobs 60 to engage the discharge plate 12. In this manner the depth of the sheet tray 10 can easily be adjusted. Thus the number of sheets deposited into the sheet tray can be adjusted.

With the bottom portions 38 and 39 of tray side walls 32 and 34 respectively holding sheets of paper or other material wide or thin sheets will tend to sag in the middle of the support surfaces of bottom portions 38 and 39. To alleviate the sagging support plate 45 is employed. The support plate 45 has a vertical rod engagement portion for connecting it to guide rod 42 thus support plate 45 in conjunction with raising and lowering the guide rod 42 and the tray side walls 32 and 34.

The tray side walls 32 and 34 have top slots 72 and 74 respectively for engaging clamps 76 and brackets 78 which in conjunction with screws 75 pivotally secure guide rod 70 adjustably in place relative to the front face 20 of discharge plate 12.

Fingers 70 are attached to guide rod 70 torsion spring 82 and clamping collar 84 such that the fingers will pivot on guide rod 70 thereby placing tension in torsion spring 82 and tending to return the fingers 70 to their original position. The fingers 70 are originally vertical to prevent articles delivered to the sheet tray 10 from escaping while being individually deposited in the sheet tray 10. The fingers 70 can be adjusted to any position along guide rod 70. The guide rod can be moved to place the fingers at any desired location for the size of sheet or other article deposited in the sheet tray 10.

When the desired count of sheets or other articles is reached, an operator, either human or robotic, removes the stack of sheets or other articles from the sheet tray by pulling the stack away from the front face 20 thus rotating the fingers 80 upward. When the sheets or other articles are removed the fingers 80 rotate back to the vertical position with the aid of torsion springs 82 and are in position to receive another stack of sheets or other articles.

A sensor mount 90 is slideably mounted on guide rod 70 to position a sensor over the sheets or articles in the sheet tray 10 to detect their presence or absence. Thus when the articles are removed a sensor, not shown, in the sensor mount 90 sends a signal to the sheet feeder, not shown, to deliver another count of sheets to stack in the sheet tray.

A sensor 100 attached to the sensor mount detects the presence of sheets in the sheet tray. When the stack of sheets is removed from the sheet tray the sensor sends a signal to the sheet feeder to count out and send another series of sheets to the sheet tray to form another stack of a known quantity of sheets.

Obviously, many modifications and variations of the present invention are possible in light of the above teachings. It is therefore to be understood that, within the scope of the appended claims, the invention may be practiced otherwise than as specifically described.

What is claimed is:

1. An adjustable depth sheet tray comprising:

a discharge plate having a front face with a plurality of vertical slits, the discharge plate having a perpendicular arm at each end thereof, each arm used for attaching the sheet tray to a sheet feeding device so that sheets can be added to a stack of sheets in the sheet tray, a depth adjustment slot in the arms of the discharge plate for adjusting the depth of the sheet tray, a guide rod extending between the depth adjustment slots in the arms, the guide rod having threaded ends, a knob having a bolt portion, the bolt portion passing through the depth adjustment slots in the arms of the discharge plate and threadedly connected to the guide rod to fix the guide rod at a desired position in the depth adjustment slots, a bracket having a threaded aperture therein slidingly attached to the guide rod such that the apertures in the brackets can be adjustably aligned with the slits in the discharge plate, a second knob having a bolt portion, the bolt portion passing through the slits in discharge plate and threadedly connecting to the bracket to fix the guide rod at a desired position, a left tray sidewall having a horizontal slot for fastening the left tray sidewall to the discharge plate by passing the second knob bolt portion though the horizontal slot, through the slit in the discharge plate and thread the bolt into the bracket on the guide rod, the horizontal slot allows for horizontal adjustment of the left tray sidewall relative to the discharge plate so that the length of the sheets added to the sheet tray may be varied, a top slot in the left tray sidewall sidewall extending perpendicularly to the horizontal slot, a right tray sidewall having a horizontal slot for fastening the right tray sidewall to the discharge plate by passing the second knob bolt portion though the horizontal slot through the slit in the discharge plate and thread the bolt into the bracket on the guide rod, the horizontal slot allows for horizontal adjustment of the right tray sidewall relative to the discharge plate, so that the length of the sheets added to the sheet tray may be varied, a top slot in the right tray sidewall sidewall extending perpendicularly to the horizontal slot, a top guide rod adjustably attached to the right and left tray walls through the top slots therein, the adjustment allows for the length of the sheets fed into the sheet tray to be varied, a finger hingedly attached to the top rod guide and spring biased to the vertical position, such that the finger forms a barrier to sheets added to the sheet tray and can be moved out of the way by a force applied to the finger on its hinge, such that the stack of sheets will move the finger out of the way when removing the stack from the sheet feeder and the spring bias will return the finger to the horizontal vertical position after the stack of sheets has been removed.

2. An adjustable depth sheet tray as in claim 1 wherein, a bottom plate attached to the guide rod and extending between the left and right tray sidewalls to support a portion of the bottom sheet in the sheet tray such that the sheets in the sheet tray do not sag.

3. An adjustable depth sheet tray as in claim 2 wherein, a sensor mount on the top rod guide to position a sensor over the stack of sheets in the sheet tray for determining if there are sheets in the sheet tray.

4. An adjustable depth sheet tray as in claim 3 wherein, a sensor in the sensor mount determines if the sheet tray is empty and signals a sheet feeder to begin sending sheets to the sheet tray.

5. An adjustable depth sheet tray as in claim 1 wherein, a sensor mount on the top rod guide to position a sensor over the stack of sheets in the sheet tray for determining if there are sheets in the sheet tray.

6. An adjustable depth sheet tray as in claim 5 wherein, a sensor in the sensor mount determines if the sheet tray is empty and signals a sheet feeder to begin sending sheets to the sheet tray.

* * * * *